US005266273A

United States Patent [19]

Coombs

[11] Patent Number: 5,266,273

[45] Date of Patent: * Nov. 30, 1993

[54] PROCESS AND APPARATUS FOR FORMING A SOLUTION GRADIENT AND FOR CONDUCTING A BLOTTING PROCESS

[76] Inventor: David H. Coombs, 650 Churchill Row, Fredericton, New Brunswick, Canada, E3B 1P6

[ * ] Notice: The portion of the term of this patent subsequent to Dec. 15, 2009 has been disclaimed.

[21] Appl. No.: 904,580

[22] Filed: Jun. 26, 1992

Related U.S. Application Data

[60] Continuation-in-part of Ser. No. 561,759, Aug. 2, 1990, Pat. No. 5,171,539, which is a continuation-in-part of Ser. No. 180,957, Apr. 13, 1988, abandoned, which is a division of Ser. No. 879,075, Jun. 26, 1986, Pat. No. 4,753,892.

[51] Int. Cl.[5] ..... B01L 11/00

[52] U.S. Cl. ..... 422/101; 210/787; 210/789; 366/208; 366/209; 366/219; 366/220; 366/232; 366/235; 422/99; 422/104; 422/258; 494/16; 494/20

[58] Field of Search ..... 422/99, 101, 104, 256, 422/258, 259; 210/787, 789, 927; 366/208, 209, 219, 220, 232, 235; 494/16-20

[56] References Cited

U.S. PATENT DOCUMENTS

| | | | |
|---|---|---|---|
| 3,244,363 | 4/1966 | Hein | 494/16 |
| 3,706,413 | 12/1972 | Blum | 494/17 |
| 3,712,535 | 1/1973 | Genese et al. | 494/20 |
| 3,882,716 | 5/1975 | Beiman | 494/11 |
| 3,958,753 | 5/1976 | Durland et al. | 494/16 |
| 4,244,513 | 1/1981 | Fayer et al. | 494/16 |
| 4,285,463 | 8/1981 | Intengan | 494/20 |
| 4,479,720 | 10/1984 | Mochida et al. | 366/214 |
| 4,753,892 | 6/1988 | Coombs | 422/256 |
| 4,865,810 | 9/1989 | Simon | 494/19 |

FOREIGN PATENT DOCUMENTS 461317 12/1991 European Pat. Off. .

OTHER PUBLICATIONS

"Multi-Purpose Rotator," p. 191 from Equipment Inst. Supp. 1974.

Cole-Parmer, "Roto-torque heavy duty rotators," p. 341 Cole-Parmer Inst. Comp., 1986.

*Primary Examiner*—Timothy M. McMahon

[57] ABSTRACT

An apparatus for conducting a blotting process comprises a support member, a first electric motor for rotating the support member about a vertical plane, a tube holder having a substantially flat surface for magnetically mounting at least one tube, a second electric motor for rotating the tube holder and a control for controlling the second electric motor. The tube holder is mounted for rotation on the support member. The tube is secured within the tube holder, the support member is rotated at a predetermined angle and the tube holder is rotated at a predetermined speed blotting reagent onto a filter.

3 Claims, 2 Drawing Sheets

10
48
46
44
30
42
28
36
24
32
34
40
22
38
12
18
14

10
30
36
28
24
22
42
26
18
20
12
14
16

PROCESS AND APPARATUS FOR FORMING A SOLUTION GRADIENT AND FOR CONDUCTING A BLOTTING PROCESS

This application is a continuation-in-part of application Ser. No. 07/561,759 now U.S. Pat. No. 5,171,539, which is a continuation-in-part of application Ser. No. 180,957 filed Apr. 13, 1988, now abandoned, which is a division of application Ser. No. 06/879,075, filed Jun. 26, 1986, now U.S. Pat. No. 4,753,892.

FIELD OF THE INVENTION

This invention relates to a process and apparatus for forming solution gradients, and more particularly to a novel process and apparatus for generating a continuous solution gradient.

This invention also relates to an apparatus for conducting a blotting process in addition to forming a solution gradient.

BACKGROUND OF INVENTION

Separation of macromolecules (proteins, DNA and RNA) and larger aggregates, such as viruses and cells, has been and continues to be one of the primary objectives in biochemical research. Perhaps the oldest and still most widely used separation technique is solution gradient density centrifugation comprising three basic steps: forming a solution gradient, e.g., of sucrose in a tube; centrifuging a sample into the gradient; and recovering the now-separated samples from various positions in the gradient-containing tube, sometimes referred to as fractionation.

The term "gradient" implies a continuous variation in concentration from top to bottom, e.g., 5% to 45% sucrose. The gradient performs two critical functions. First and foremost, the gradient prevents mixing in a vertical direction. During acceleration and deceleration of the tube in the centrifuge, a mild degree of mixing is induced which, if unchecked by the gradient, would thoroughly mix the contents in the tube. The gradient, however, prevents such mixing of the density differential between adjacent layers. Secondly, heavier sucrose solutions are much more viscous than light sucrose solutions and consequently, there is established a viscosity gradient. Such a viscosity gradient is useful because "g" forces are greatest at the bottom of the tube (highest radius from the center of rotation) and the increased viscosity effectively cancels the increased "g" forces giving a nearly uniform rate of molecule or particle migration from top to bottom, and consequently one can predict the position of the desired molecules at the end of a run.

One of the most serious problems in the constructions of sucrose gradients is reproducibility. It is apparent that the rate of migration of any molecular species through a gradient is subject to the cumulative effects of buoyancy and viscosity of the gradient. Since these two parameters are caused by the shape of the sucrose gradient itself, tube to tube variation in the gradient will produce tube to tube variation in the final position of any molecular species. Often, it is desired to determine whether subtle changes have occurred in the size or shape of cell components, and with very reproducible gradients, such differences may be detected. By the same token, the absolute shape of the gradient is less important so long as the gradient is reproducible.

There has been a steady but slow evolution in the techniques used to form sucrose gradients, beginning with the laborious manual layering of one solution after another into a tube requiring a plurality of pipettes, a steady hand and mountains of patience and time. Such a technique was quickly supplanted with a technique similar to chromatographic technology wherein two solutions, in this case, the highest and lowest sucrose concentrations in a desired gradient, are measured into two adjacent chambers. The mixing chamber (heavy sucrose) is connected to a centrifuge tube on one side and other chamber (light sucrose), on the other side. As the mixing chamber's contents empty into the centrifuge tube, the contents of the other chamber enter and gradually lower their sucrose concentration. As the chambers empty, the outflow approaches the light chamber's concentration. Such chromatography-like technology is the most commonly used technique and produces either linear or exponential gradients with minor modification, but has two major drawbacks, i.e., time and reproducibility. When more than one gradient is desired the outflow must be partitioned, and nothing has yet been developed that will ensure exactly the same flow into each tube. Consequently, a user must watch the level in each tube, clamping off the fast ones until the slow ones catch up, etc. Additionally, there will be slight differences between the gradient in the various tubes because of constant flow adjustments.

Another technique currently in use is a freeze-thaw method, wherein a homogenous solution is introduced into a centrifuge tube and the tube is subjected to a plurality of freeze-thaw cycles. Such a freeze-thaw method suffers from a serious drawback in that, while the freezing and thawing produces a gradient (ice floats and excludes solute molecules from the pure water matrix), any buffer is subjected to the same forces and also ends up as a gradient, producing numerous potential artifacts. Reproducibility is poor because no two tubes thaw out exactly the same way, and also because the gradients decay with time.

Blotting is the generic name for a variety of techniques that permit the visualization of proteins and nucleic acids (DNA & RNA) on filters. Most frequently, these molecules have been separated on a gel made of acrylamide or agarose and have been resolved into a series of "bands" that reflect the molecular weight of each resolved species. These bands resemble the pattern of railroad ties along a track, and in fact, the lanes of bands resolved from a single sample are often referred to as tracks.

These separations are normally carried out under the influence of an electrical field, with the molecules being driven through the molecular matrix by their net electrical charge.

Once the separation is complete, there must be some means of visualizing the bands, since proteins and nucleic acids are not normally visible to the naked eye. Often the gel itself is stained and destained using a dye that is taken up by the molecule in question. Alternatively, the molecules can be made radioactive and their presence detected by exposing the gel to a piece of X-ray film in a process called autoradiography. If more sensitive or specific staining is required, then blotting is the method of choice.

Blotting begins with the electrophoretic or capillary transfer of the bands to the surface of a special piece of filter paper that has a strong affinity for the type of molecule in question. The gel, in the form of a thin slab, and the filter paper are mated in sandwich fashion and the elution of bands onto the filter is carried out. As the bands leave the gel, they adhere to the surface of the filter in precisely the same position they occupied in the gel.

There are two basic classes of methods of detection once bands have been transferred to the filter. In the first class, staining or autoradiography is used to reveal the position of the bands. These methods do not reveal anything new about the molecules and are carried out for a variety of reasons, including increased sensitivity during autoradiography and recovery of purified proteins from stained blots.

The second method involves the detection of bands using a variety of probes which are specific to a fraction of the molecules that has been separated, rather than to all of them. For example, a Western blot is used to detect the AIDS virus. The patient's serum is used to probe a blot that has all the viral proteins separated on it. All serum contains large amounts of proteins called antibodies that are used by the immune system to fight infection. If the person is infected by the AIDS virus, they will have antibodies in their serum that will bind to the viral proteins on the filter. If they are not infected, they will lack such antibodies. The second step is to detect where the antibodies have bound to the blot.

For nucleic acids, a Northern or Southern blot is used. A labelled nucleic acid probe will form a base pair with nucleic acid fragments that have been separated on the blot if and only if they have a sequence which is complementary to that of the probe. The label carried by the probe is then used to reveal the position of those band(s) which are complementary to it.

Thus all three methods, Western, Northern and Southern blots, begin with a filter and a probe. For the blot to be effective, the probe is in solution and must be evenly distributed over the surface of the blot and mixed periodically to ensure maximum sensitivity.

There have been two techniques commonly used to accomplish this; open trays and seal-a-meal bags. The former has been used more with Westerns, which occur at room temperature, while Northerns and Southerns are done in bags because of the high evaporation rates produced by the high temperatures required for the hybridization.

The types of probes used in protein and nucleic acid blot development have been different until very recently. The hybridizations used with Northerns and Southers are relatively straightforward. The filter is treated to remove non-specific binding sites and the probe is added to an overnight, high temperature hybridization. Unbound probe is rinsed off and the blot is exposed by autoradiography.

Westerns are more involved because the presence of the bound primary antibody must be identified. Protein stains are of no use because they will stain non-target proteins as well. Thus a second antibody linked to a special enzyme is incubated with the blot. It is specific for the first antibody and binds only where it finds it bound to target protein. After extensive rinsing to remove all unbound antibody, a colourless substrate is added to the blot. Wherever the enzyme bound to the second antibody exists, the substrate is cleaved and converted to an insoluble coloured product which deposits on the blot and reveals the position of the bands detected by the first antibody. This is a multi-step process that is difficult to carry out in bags because of all the opening and resealing required.

Interestingly, a new technique has recently emerged called chemiluminescence in which the enzyme cleaves a molecule that gives off tiny bursts of light (photons). Thus if a piece of autoradiography film is placed over the filter, the position of bands detected by the probe is revealed as a dark band on the film. This technique has been adapted for non-radioactive detection of nucleic acids in Northerns and Southerns and requires as many steps as the Western technique.

OBJECTS OF THE INVENTION

It is an object of the present invention to provide a novel process and apparatus for generating continuous solution gradients.

Another object of the present invention is to provide a novel process and apparatus for generating continuous solution gradients of faithful reproducibility.

Still another object of the present invention is to provide a novel process and apparatus for generating continuous solution gradients in short periods of time.

Yet another object of the present invention is to provide a novel process and apparatus for generating continuous solution gradients obviating the necessity for personal supervision.

A further object of the present invention is to provide a novel process and apparatus for simultaneously generating a plurality of continuous solution gradients.

A still further object of the present invention is to provide a novel process and apparatus for generating continuous solution gradients using reliable equipment components.

Yet another object of the present invention is to provide a novel process and apparatus for generating continuous solution gradients of extended useful life prior to gradient decay.

Yet another object of the present invention is to provide a novel apparatus for generating a continuous solution gradient and for conducting a blotting process.

SUMMARY OF THE INVENTION

These and other objects of the present invention are achieved by a novel process and apparatus for generating a continuous solution gradient wherein solutions of differing concentrations are layered in a tube, and the tube is disposed at an angle with respect to the vertical and is rotated for a predetermined period of time, thereby to generate a continuous solution gradient, i.e., continuous variation in concentration between the concentration of the initial solutions.

According to one aspect of the present invention, there is provided a process for generating a continuous solution gradient which comprises the steps of: (a) introducing into a tube solutions of differing concentrations in a manner to layer the solutions therein; (b) inclining the tube into a angle with respect to the vertical; (c) rotating the tube thereby to form the continuous solution gradient; and (d) discontinuing step (c) after formation of the continuous solution gradient.

In another preferred embodiment, there is provided an apparatus for generating a continuous solution gradient and for conducting a blotting process which comprises: a support member; means for rotating the support member about a vertical plane; a tube holder mounted for rotation on the support member; and means for rotating the tube holder.

In a specific form of one embodiment of the present invention, the apparatus includes a tube or container support which is rotatable with respect to the vertical and rotatable with respect to the horizontal. The tubes or containers are placed within a holder to be received on a support. The housing of the apparatus includes a keypad and an indicator, the keypad being linked to a program which allows control of the angle of inclination of the tube holder containing the tubes, the speed of rotation of the tubes, the duration of rotation, and as well, interrupt functions.

In another embodiment of the invention, the apparatus includes transparent tubes or containers which additionally include transparent stoppers. The tubes or containers incorporate a magnetic substance at their base and are thus adapted to be placed directly on the support. This allows differently sized tubes, jars or containers to be processed simultaneously while the contents thereof remain completely visible to the user of the apparatus. Further, the user may program the angle of inclination with extreme precision, i.e., within 0.1°. The housing of the apparatus in this embodiment is adapted to receive a separate memory cartridge, which allows multiple users to each have his or her own parameters preset without having to reprogram the apparatus after subsequent users.

In greater detail of certain embodiments of the present invention, the apparatus includes a tube holder in the form of a mounting member for mounting the tubes at or near their bases; such a tube holder is adapted to retain the tubes in a spaced apart position by magnetic or the like means to permit the tubes to be rotated with an angular inclination between the horizontal and the vertical. To this end, the tube holder may be a flat base having a metal surface or the like adapted to cooperate with magnetic means associated with the tubes whereby when a tube is mounted or placed on the tube holder, the magnetic means is sufficient to retain the tube on the tube holder.

In another embodiment, the tubes preferably comprise tubes having magnetic means associated with the tubes. To this end, the tubes may be provided with a magnetic film secured to the base and/or lower portion thereof to permit releasable mounting by the tube holder.

The use of the magnetic feature described above makes it very easy to change reagents while at the same accepting any bottle size without requiring a change of the supporting member or tube holder. In addition, by utilizing this arrangement, accurate control of a tilt angle during the rotation can be achieved with the resulting savings in reagents compared to other apparatus which utilizes, e.g., horizontal arrangements. Utilizing applicant's process and apparatus of this embodiment, a blotting procedure may be carried out at any desired angle, e.g., 88° or 89°, such as when a filter may be smaller than the length of the tube or bottle. By tilting the bottle and placing a filter so that its bottom edge touches the bottom of the tube or bottle wall, less reagent is required. Thus, for example, a thin, one centimeter strip may only require 1 ml of reagent to cover the whole bottom of a tube or bottle rotating horizontally.

If desired, the present invention may be operated in conjunction with a programmable system utilizing conventional programming techniques and conventional controllers to provide a determined timing and tilt for a given blot and to provide an automatically reproducible procedure. As will be understood by those skilled in this art, a suitable program may be provided whereby the time, angle and speed of rotation for each step can be preset and the controller utilized to initiate the process utilizing very few keystrokes.

In a further aspect of the invention, the preferred apparatus has been modified so that it is programmable for all the steps required for the entire blotting procedure and such that it has a steel plate that can hold the magnetized bottles and rotate them at the time angle and speed required for each of the many steps in the blotting process.

BRIEF DESCRIPTION OF THE DRAWINGS

A better understanding of the present invention as well as other objects and advantages thereof will become apparent upon consideration of the detailed disclosure thereof, especially when taken with the accompanying drawings, wherein.

DETAILED DESCRIPTION OF THE DRAWINGS

Figure 1:
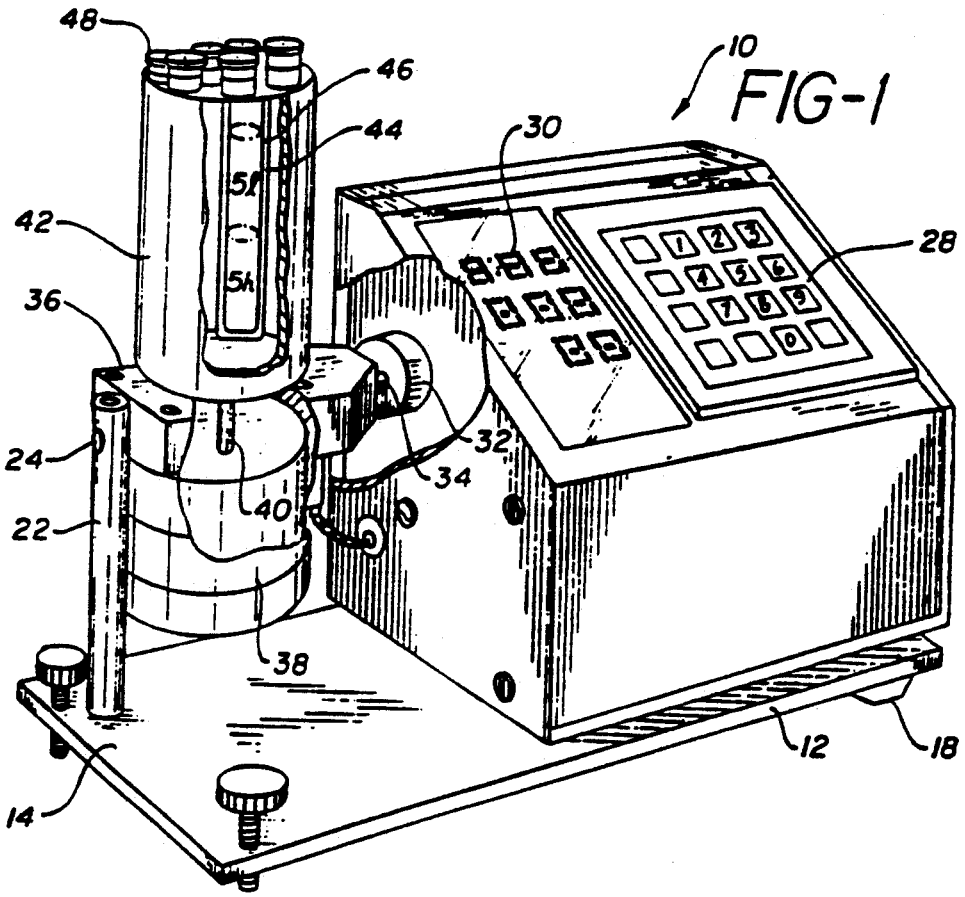
FIG. 1 is an isometric view, partially cut away, of a continuous gradient generating assembly of the present invention.
Figure 2:
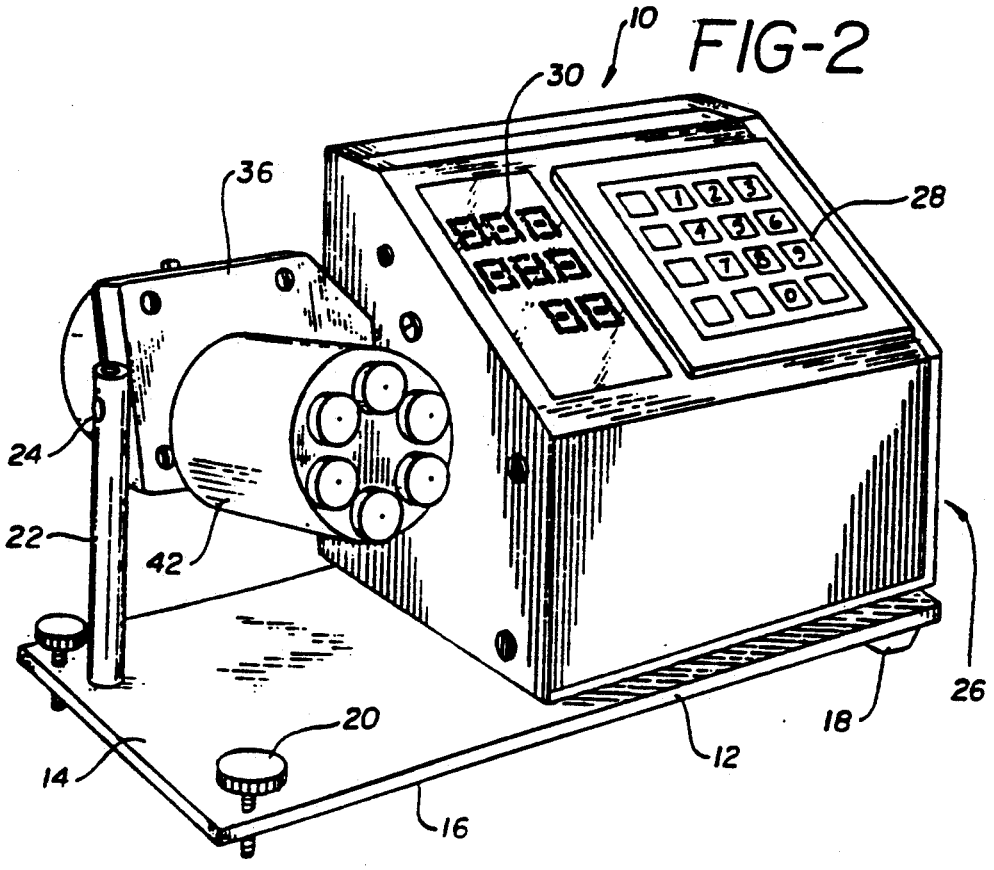
FIG. 2 is an isometric view of the continuous gradient generating assembly in a rotating mode.

Referring now to the drawings, there is illustrated a continuous gradient generating and blotting assembly, generally indicated at 10, for effecting the process of the present invention and comprised of a rectangularly-shaped base member 12 having an upper surface 14 and a lower surface 16. On the lower surface 16 of the rectangularly-shaped base member 12, there are positioned leg members 18 (one shown) disposed proximate one side thereof. On the other side of the rectangularly-shaped base member 12, there are provided thumb-type screw members 20 disposed in threaded orifices (not shown) formed in the rectangularly-shaped base member 12 for levelling of the continuous gradient generating assembly 10.

Extending upwardly form the rectangularly-shaped base member 12 on a side thereof proximate the thumb-type screw members 20, there is positioned a vertically disposed cylindrically-shaped support member 22 having a channel 24 formed in an upper end portion therein perpendicularly disposed to the axis of the vertically disposed cylindrically-shaped support member 22. On the other side of the rectangularly-shaped base member 12, there is positioned an operating console member, generally indicated at 26, having a keyboard 28, digital read-out members 30 and concomitant electronics (not shown) including a central processing unit (CPU) and related microprocessors. Within the operating console member 26 there is mounted an electric motor 32 having a shaft 34 and mounted to a side wall of the operating console member 26. The shaft 34 extends horizontally towards and is disposed in the channel 24 of the vertically disposed cylindrically-shaped support member 22 and is mounted for rotation within the channel 24 of the vertically disposed cylindrically-shaped support member 22.

To the shaft 34 intermediate the vertically disposed cylindrically-shaped support member 22 and the side wall of the operating console member 26, there is mounted a support plate member 36 for rotation with the shaft 34 about the horizontal in response to rotation of the commutator of the electric motor 32, as more fully hereinafter discussed. To a bottom surface of the support plate member 36 there is mounted an electric motor 38 including a shaft 40 mounted to a commutator thereof and, journaled for rotation, is a bearing member (not shown) disposed in the support plate member 36. To the shaft 40 extending above the support plate member 36, there is mounted a tube holder 42 having a plurality of cylindrically-shaped channels 44 disposed radially about a center axis of the tube holder 42. In the position illustrated in FIG. 1, the support plate member 36 is disposed in the horizontal plane with the shaft 40 or the electric motor 38 and the tube holder 32 mounted to the shaft 40 being perpendicularly disposed thereto, i.e., in the vertical. Rotation of the shaft 34 of the electric motor 32 causes the support plate member 36 to rotate about the horizontal, thereby causing the tube holder 42 to rotate in a vertical plane perpendicular to the horizontal, as more fully hereinafter discussed. Rotation of the shaft 40 of the electric motor 38 causes the tube holder 42 to rotate in an axis of the vertical plane determined by the preselected rotation of the shaft 34 of the electric motor 32.

To facilitate an understanding of the process of the present invention, the process of the present invention will be described with reference to the formation of a continuous sucrose gradient. It will be understood by one skilled in the art that the process of the invention may use any tube size, as well as the fact that continuous solution gradients may be formed of solutions other than sucrose, e.g., Ficoll, Percoll, Ficoll-PAQUE (registered trademarks of Pharmacia Laboratories).

Equal volumes of solutions representing a solution of low concentration ($S_l$) and a solution of high concentration ($S_h$) are layered in a tube 46 generally with the tube 46 in a vertical position. It has been observed that pre-mixing of the solutions may be minimized by first introducing the solution of the lower concentration ($S_l$) into the tube and then introducing into the lower end portion of the tube 46 by a cannula syringe the solution of the higher concentration ($S_h$), thereby floating the solution of the lower concentration onto the solution of the higher concentration. To initially establish optimum processing conditions for a particular continuous solution gradient, a dye is admixed in the solution of higher concentration to permit visual observation of gradient formation for any such gradient system, as more fully hereinafter discussed.

After layering of the solutions, the tube 46 is enclosed, preferably using a stopper 48 having a channel (not shown) configured to permit the removal of air from the tube during insertion of the stopper 48 into the open end of the tube 46 in a manner which eliminates any gaseous phase in the tube 46 at completion of the act of insertion of the stopper 48 into the tube 46. Any gaseous phase in the tube 46 is deleterious to gradient formation. The tube 46 is thereupon inserted into one of the cylindrically-shaped channels 44 of the tube holder 42, and the tube holder 42 is then inclined from the vertical in response to rotation of the shaft 34 by the electric motor 32 to an angle to the vertical generally of from about 50° to the 89.9°. It has been found that a particular preferred angle is defined by the tube with respect to the vertical when the meniscus formed between the layers first contacts the lower end portion of that end of the stopper 48 inserted into the tube 46, i.e., the meniscus extends laterally across the tube 46 in contact with the lower end portion of the stopper 48.

Upon reaching a predetermined angle of inclination, the tube holder 42 is caused to be rotated in response to rotation of the shaft 40 of the electric motor 38 by energizing the field thereof. The tube 46 is caused to be rotated for a predetermined period of time, generally of from about 1.5 to 5 minutes at a rotational speed of from about 10 to about 25 RPM's, during which time the solution of the higher concentration is caused to rise along the inner tube wall and by such contact with the solution of lower concentration flowing over the interface there between, there is formed a continuous solution gradient. Once the continuous gradient is established, the tube holder 32 is righted to the vertical and the tube 46, removed from the channel 44 for use in a subsequent protocol.

Figure 3:
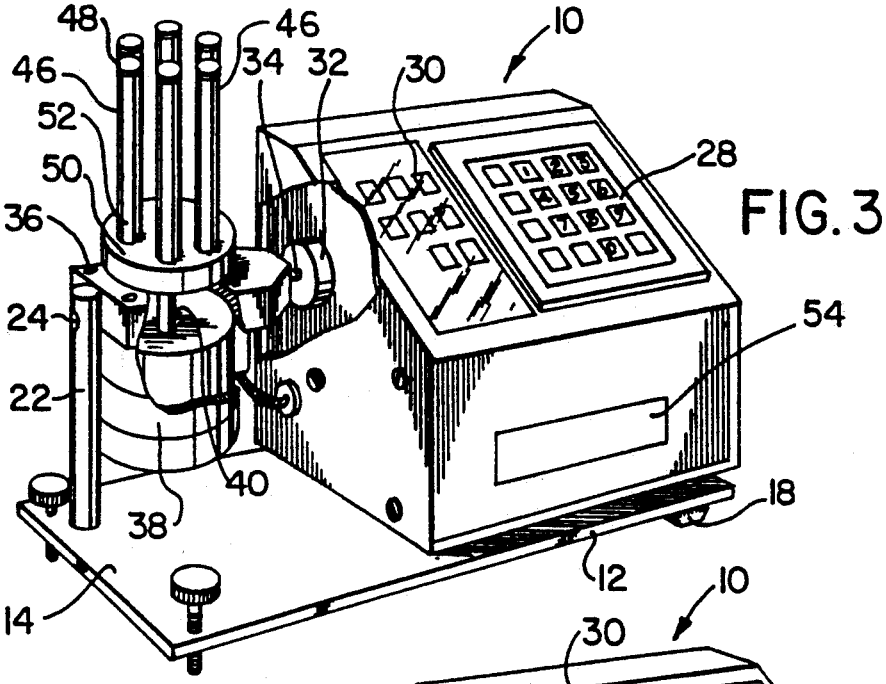
FIG. 3 is an isometric view of an alternate embodiment of the present invention.
Figure 4:
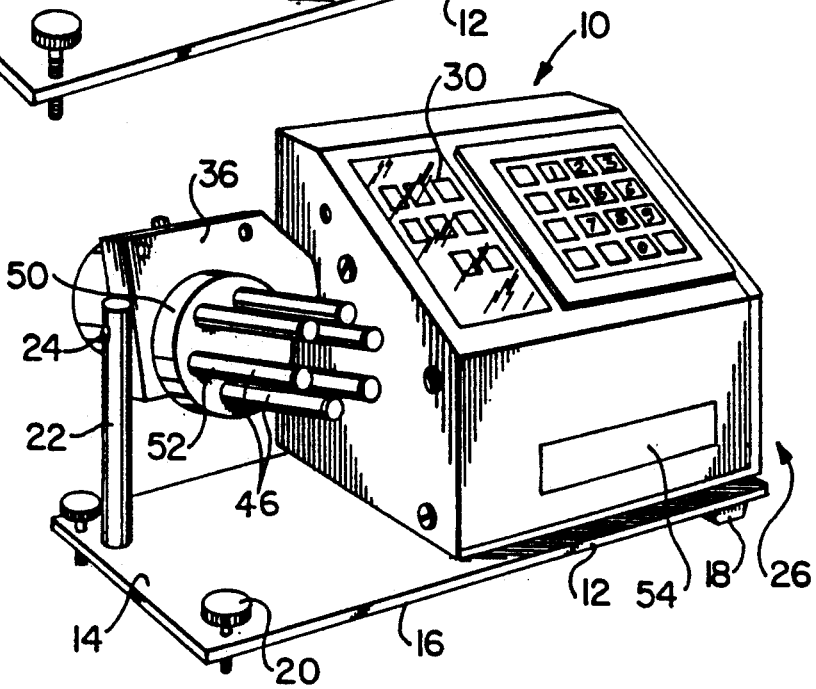
FIG. 4 is an isometric view of the embodiment of FIG. 3 in a rotating mode.

Referring to FIGS. 3 and 4, there is shown an alternate embodiment of the present invention. In this embodiment, the arrangement permits a clear view of the tubes or bottles mounted by the tube holder, whereby a user may adjust the tilt to cover only a part of the bottle where the blot lies and to permit a clear view of the blot as the colour develops.

In this arrangement, the device positions tubes 46 directly onto a tube support 50. The support 50 in this embodiment may be a flat support of, e.g., metallic construction. The support 50 may be exchanged with the tube holder 42 by removing the holder from the shaft 40. The tubes or containers 46 preferably include a magnetic base on the lower ends 52 thereof, which attracts the support 50. To this end, the tube may include a magnetic film secured to the outside of the tube base as shown in FIGS. 3 through 5.

Figure 5:
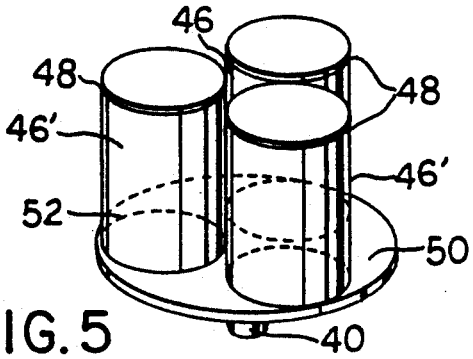
FIG. 5 is an enlarged isometric view of a portion of another alternate embodiment of the present invention.

In FIG. 5, a portion of the assembly of another alternate embodiment of the invention is illustrated in an enlarged view of the tubes 46', support 50, and shaft 40. As in the FIG. 3 arrangement, shaft 40 is associated with an electric motor (not shown in FIG. 5). The tubes 46' have stoppers 48 at their upper ends, and a magnetic base 52 which attracts support 50. As illustrated in FIG. 5, the diameter of tubes 46' is larger than the diameter of tubes 46, and accordingly, a fewer number of tubes are disposed on support 50. In the FIG. 5 arrangement, the magnetic base 52 permits different sizes of tubes 46' to be mounted on support 50, and further, combinations of different sizes of tubes may also be mounted concomitantly on support 50.

The stoppers 48 and the tubes 46 and 46' preferably are transparent to enable clear visibility of the contents, which additionally aids in determining the point at which an ideal meniscus is formed. The tubes 46 and 46' may be tubular or cylindrical in shape depending upon the desired application, and as discussed above with respect to FIG. 5, the diameter of the tubes may also vary.

In a preferred embodiment, the above-described apparatus may operate in conjunction with a conventional controller which includes operating console 26, including the keyboard 28, digital read-out 30, and electronics having a CPU and related microprocessors (not shown). Suitably, the program utilized in carrying out the process will provide the option of setting the angle of inclination of the tubes, the speed of rotation and duration of rotation. The console includes a slot 54, in communication with the internal electronics, which is adapted to receive a separate memory cartridge (not shown). The cartridge allows each user to have his or her own parameters preset, i.e., the angle of inclination, speed of rotation and duration of rotation without having to reset these parameters after consecutive users.

An important aspect of the present invention, in addition to establishing a preferred predetermined tilt angle, is a requirement to establish a predetermined time of rotation for any given rotational speed. For this aspect, visual reliance is placed upon the dye and its migration from the higher concentrated solution into the lower concentrated solution. The formation of a continuous solution gradient is widened by the dye extending to the top of the lower concentrated solution. Upon reaching the point at which the dye has completed initial migration into the solution of lower concentration, rotation of the tube should be discontinued. Extended rotation of the tube, e.g., for more than about 5 seconds after observation of migration, should be avoided, since degradation of the continuous solution gradient will thereafter begin and solution homogeneity result with uncontrolled time for discontinuing rotation of the tube.

It will be understood that at low rotational speeds the time of formation of the continuous solution gradient is longer than at higher rotational speeds, and that there are lower and upper limits of rotational speed at which a continuous solution gradient may not be efficaciously formed. Generally, at rotational speeds in excess of about 60 RPM, usable gradients may not be formed. While in the apparatus of the present invention, the tube 46, in which the continuous solution gradient is being armed, is positioned in a chamber displaced from the axis of rotation of the tube holder 42, the tube 46 may be rotated about its axis with like results. Additionally, wile the use of a dye has been described in initial determinations of tilt angle time periods for rotation of the tubes, etc., in a visual determination, it will be understood that other methods for determining such process conditions will be understood by one skilled in the art. It will also be understood that the configuration of the tube in which the continuous solution gradient is to be formed is also important in the determination of appropriate processing conditions. Once having established processing conditions for generating a specific continuous solution gradient from specific solutions using a dye, the resulting processing conditions, i.e., tilt angle, rotational speed and duration of rotation, etc., may be readily introduced as required into the central processing unit or may be preprogrammed and accessed by appropriate language to the CPU thereby to insure faithful reproduction of specific solution gradients from specific initial solutions.

To conduct a blotting process, a filter is placed in a bottle or tube 46 or 46' so that it lies around the inside wall, and a small amount of reagent containing the probe is placed in the bottle 46 or 46'. The bottle is then capped with stopper 48. The bottle or tube 46 or 46' has a magnetic base 52 for releasably securing the bottle to the support 50. The tube holder is rotated to about 88 or 89° turning the bottle or tube on its side. The bottle or tube is then rolled. The liquid forms a shallow bath along the bottom side of the bottle and the filter rotates through the solution at speeds from 1–30 RPM with the preferable rate being 6–10 RPM. The effect is one of dipping the filter completely in and out of a solution 6–10 times a minute.

The preferred agle of rotation has been disclosed. However, it is apparent to one skilled in the art that if a larger volume of reagent is being used a lesser angle of rotation may be used, for example between about 80 to 88°, provided the filter is fully dipped in the reagent or solution once per revolution of the tube.

The efficacy of such a thorough rinsing improves the results of the blotting process. A further advantage is that the probe volume required is a small fraction of that required in trays or bags. This lowers the user's consumption of expensive probes from 70–90% and allows high probe concentrations which promote maximum sensitivity.

While the invention herein has been described in connection with exemplary embodiments thereof, it will be understood that many modifications will be apparent to those of ordinary skill in the art, and that this application is intended to cover any adaptations or variations thereof. Therefore, it is manifestly intended that this invention be only limited by the claims and the equivalents thereof.

I claim:

1. An apparatus for generating a continuous solution gradient and for conducting a blotting process by blotting a quantity of reagent onto a filter, which comprises:

a support member, first electric motor means for rotating said support member about a vertical plane;

a tube holder having a substantially flat surface for magnetically mounting at least one tube, said holder being mounted for rotation on said support member;

second electric motor means for rotating said tube holder; and control means for controlling said second electric motor means, whereby when said tube is secured within said tube holder and is rotated at a predetermined speed and said support member is rotated to a predetermined angle to the vertical, said reagent is blotted onto said filter once per revolution of said tube.

2. An apparatus as claimed in claim 1 wherein said apparatus further includes a tube adapted to receive said quantity of reagent and said filter, said tube having a magnetic film for releasably mounting said tube within said tube holder.

3. An apparatus as claimed in claim 1 wherein said support member is rotatable from vertical to about 50° to 89.9°.

* * * * *